US006621206B2

(12) United States Patent
Shimizu et al.

(10) Patent No.: US 6,621,206 B2
(45) Date of Patent: Sep. 16, 2003

(54) COLOR CATHODE RAY TUBE

(75) Inventors: Norio Shimizu, Fukaya (JP); Masatsugu Inoue, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/897,050

(22) Filed: Jul. 3, 2001

(65) Prior Publication Data

US 2002/0003396 A1 Jan. 10, 2002

(30) Foreign Application Priority Data

Jul. 4, 2000 (JP) ..... 2000-202340

(51) Int. Cl.[7] ..... H01J 29/10
(52) U.S. Cl. ..... 313/461
(58) Field of Search ..... 313/402–408

(56) References Cited

U.S. PATENT DOCUMENTS 5,534,746 A 7/1996 Marks et al.
6,441,545 B1 * 8/2002 Shimizu et al. ..... 313/402

FOREIGN PATENT DOCUMENTS

GB 2 175 132 11/1986
JP 11-176334 7/1999

OTHER PUBLICATIONS

Patent Abstracts of Japan, JP 11–054062, Feb. 26, 1999.

* cited by examiner

*Primary Examiner*—Sandra O'Shea
*Assistant Examiner*—Sumati Krishnan
(74) *Attorney, Agent, or Firm*—Oblon, Spivak, McClelland, Maier & Neustadt, P.C.

(57) ABSTRACT

A panel is provided with a substantially rectangular effective portion that has a substantially flat outer surface, and a phosphor screen is formed on the inner surface of the effective portion. A shadow mask that is opposed to the phosphor screen includes a substantially rectangular mask body formed having a large number of electron beam holes and a mask frame supporting the peripheral edge portion of the mask body. The interval between the electron beam holes in the direction of the major axis of the mask body increases from the center of the mask body toward the major axis end so that the rate of change of the interval has a maximum value in the region between the center of the mask body and the major axis end.

4 Claims, 5 Drawing Sheets

COLOR CATHODE RAY TUBE

CROSS-REFERENCE TO RELATED APPLICATIONS

This application is based upon and claims the benefit of priority from the prior Japanese Patent Application No. 2000-202340, filed Jul. 4, 2000, the entire contents of which are incorporated herein by reference.

BACKGROUND OF THE INVENTION

1. Field of the Invention

The present invention relates to a color cathode ray tube, and more particularly, to a color cathode ray tube having the outer surface of an effective portion of its panel flattened.

2. Description of the Related Art

In order to display a color image without a color drift on a phosphor screen of a color cathode ray tube, in general, three electron beams that are passed through electron beam holes of a shadow mask must be landed correctly on their corresponding three-color phosphor layers of the screen. To attain this, the shadow mask should be accurately located in a given position relative to a panel. It is necessary, therefore, to set the distance (value q) between the panel and the shadow mask accurately and appropriately.

If the pitch of the three-color phosphor layers, that is, the interval between each two adjacent phosphor layers of each color, out of the phosphor layers of three colors arranged in a given order (e.g., in the order of red (R), green (G), blue (B), red (R), . . .), is PHp, it is ideal to adjust an interval d between two of each three adjacent phosphor layers to d=(⅔) PHp, in order to set the value q appropriately. If the value q is not set appropriately for the phosphor layer pitch PHp, however, black non-luminous layers cannot be wide enough, so that the color purity easily lowers as the color image is displayed. The black non-luminous layers can be assured of a satisfactory width if the phosphor layer pitch PHp is wide enough. If the phosphor layer pitch PHp is too wide, however, the resolution will be lowered.

In order to improve the visibility of modern color cathode ray tubes, moreover, the curvature of the outer surface of the panel is expected to be reduced (or the radius of curvature be increased) so that the outer surface is substantially flat. For higher visibility, therefore, the curvature of the inner surface of the panel must be also reduced. In order to land the electron beams accurately on the phosphor layers of the inner surface of the panel, moreover, the value q must be set appropriately, as mentioned before, so that the curvature of the body of the shadow mask that has the electron beam holes must be also reduced to match the inner surface of the panel.

If the curvature of the shadow mask body is reduced, however, the mechanical strength of the shadow mask lowers, so that the mask may be deformed in manufacturing processes for a cathode ray tube. If the curvature of the shadow mask body is reduced, moreover, the shadow mask howls against voices or sounds from a TV set in which the color cathode ray tube is incorporated. The deformation or howling of the shadow mask causes dislocation of beam landing. If the electron beams traverse the black non-luminous layers and cause any other phosphor layers than the phosphor layer of a desired color to glow, owing to the dislocation of beam landing, the color purity is lowered.

According to the principle of operation of the color cathode ray tube, the electron beams that pass through the electron beam holes of the shadow mask and reach the phosphor screen account for ⅓ or less of all the electron beams that are emitted from an electron gun structure. The other electron beams having failed to reach the phosphor screen run against any other portions of the shadow mask than the electron beam holes and are converted into thermal energy, whereby the shadow mask is heated. The resulting thermal expansion causes so-called doming such that the shadow mask bulges toward the phosphor screen. If the distance between the phosphor screen and the shadow mask, that is, the value q, exceeds its tolerance limit, beam landing on the phosphor layers is dislocated. Thus, the electron beams traverse the black non-luminous layers and cause some other phosphor layers than the phosphor layer of the desired color to glow, thereby lowering the color purity.

The dislocation of beam landing that is attributable to the thermal expansion of the shadow mask substantially varies depending on the brightness of displayed image patterns, the duration of the patterns, etc. If a high-brightness image pattern is displayed locally, in particular, local doming occurs, so that local dislocation of beam landing is caused in a short time.

The beam landing dislocation that is attributable to the local doming occurs most prominently when the high-brightness image pattern is displayed in a region at a distance corresponding to about ⅓ of the distance between a pair of short sides (or the overall width in the direction of the major axis) of the screen from the center of the screen. Accordingly, the black non-luminous layers should be made as wide as possible in order to prevent landing mistake in this region.

Thus, intervals between electron beam hole rows in the shadow mask body are simply increased from the center of the screen toward the periphery to maintain the width of the black non-luminous layers in the peripheral portion of the screen without lowering the mechanical strength of the shadow mask body. In this case, however, it is hard to maintain the flatness of the panel without lowering the mechanical strength of the shadow mask and fully to prevent deterioration of color purity that is attributable to local doming.

BRIEF SUMMARY OF THE INVENTION

The present invention has been contrived in consideration of these circumstances, and its object is to provide a color cathode ray tube with high visibility, in which deterioration of color purity attributable to deformation or doming of a shadow mask is lessened.

According to the present invention, there is provided a color cathode ray tube comprising: an envelope including a panel, having a substantially rectangular effective portion with a substantially flat outer surface, and a funnel bonded to the panel; a phosphor screen formed on an inner surface of the panel and including phosphor layers and black non-luminous layers; an electron gun structure located in a neck of the funnel and capable of emitting electron beams toward the phosphor screen; and a shadow mask opposed to the phosphor screen and including a substantially rectangular mask body formed having a large number of electron beam holes and a mask frame supporting of the mask body, the envelope having a tube axis extending through the respective centers of the effective portion and the electron gun structure, a major axis extending at right angles to the tube axis, and a minor axis extending at right angles to the tube axis and the major axis, the interval between each two adjacent electron beam holes on the major axis of the mask body being greater at the major axis end of the mask body than in the center, the interval between the electron beam holes increasing toward the major axis end so that the rate of change of the interval has a relative maximum value in the region at the distance of L/4 to 3L/4 from the center of the mask body, where L is the distance from the center of the mask body to the major axis end along the major axis.

Even if the curvature of the outer surface of the effective portion of the panel is reduced to improve visibility, according to the color cathode ray tube constructed in this manner, the color purity can be prevented from being lowered by dislocation of beam landing that is attributable to local doming of the shadow mask body or deformation of the shadow mask body caused in a manufacturing process or by external impact, so that improved image quality can be ensured.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

Color cathode ray tubes according to preferred embodiments of the present invention will now be described in detail with reference to the accompanying drawings.

Figure 1:
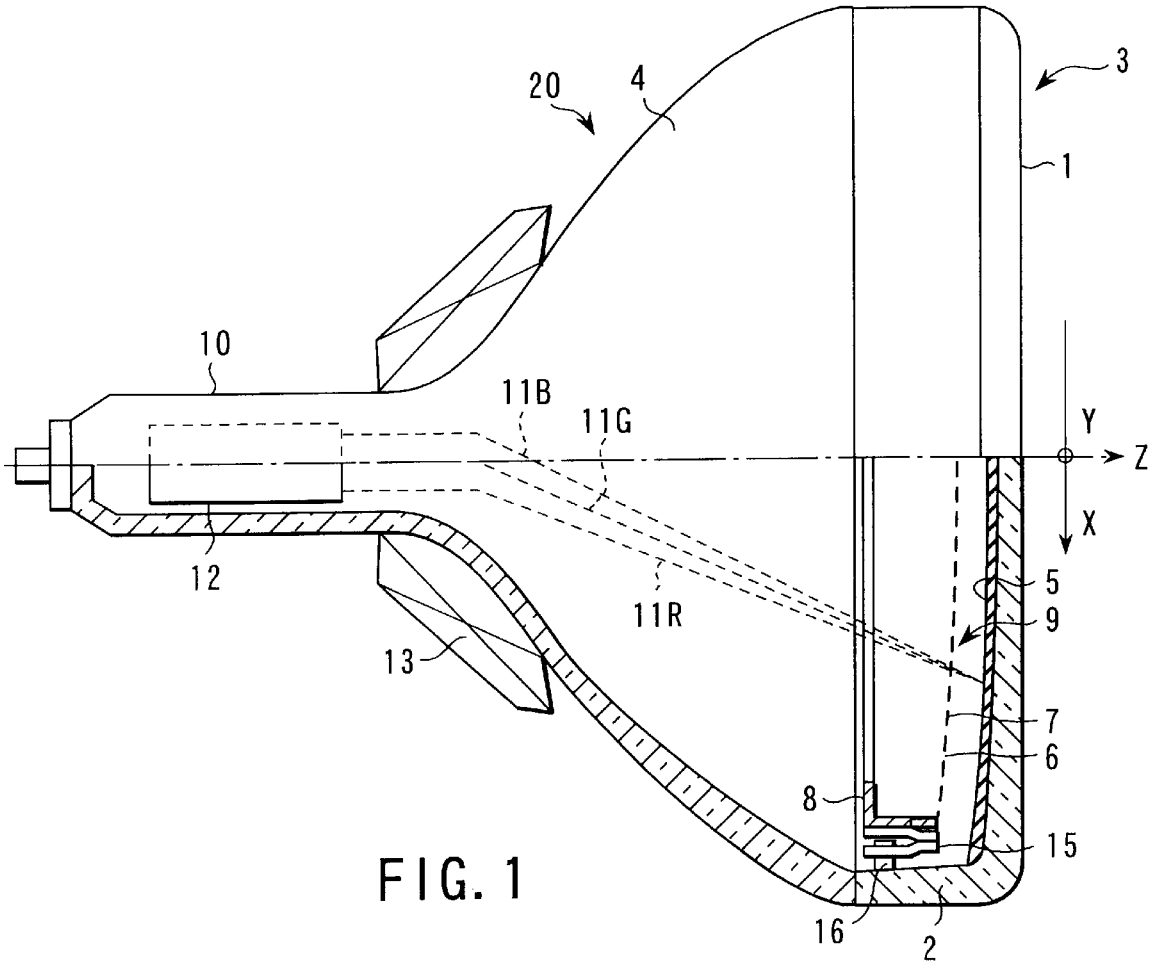
FIG. 1 is a sectional view showing a color cathode ray tube according to an embodiment of the present invention.

As shown in FIG. 1, a color cathode ray tube comprises a vacuum envelope 20 of glass that includes a panel 3 and a funnel 4. The panel 3 includes a substantially rectangular effective portion 1 and a skirt portion 2 set up on the peripheral portion of the effective portion 1. The funnel 4 is bonded to the skirt portion 2. In FIG. 1, an axis that extends through the center of the effective portion 1 and an electron gun structure 12 is defined as a tube axis Z; an axis that extends at right angles to the tube axis Z, as a major axis (horizontal axis) X; and an axis that extends at right angles to the tube axis Z and the major axis X, as a minor axis (vertical axis) Y.

Figure 2:
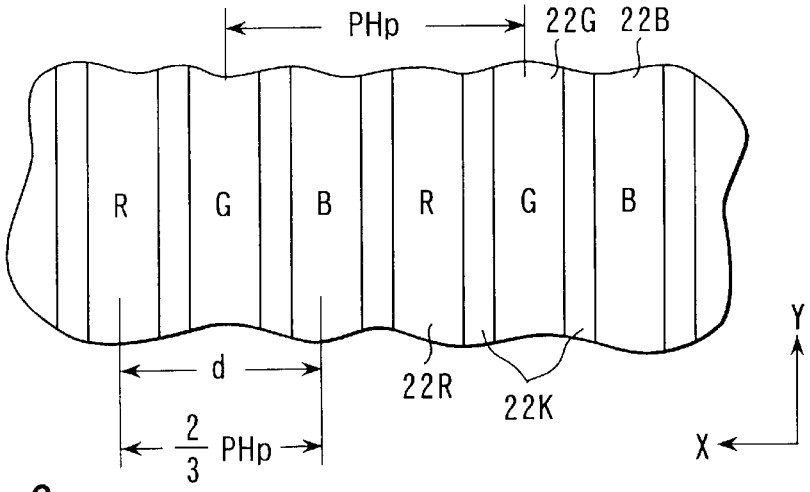
FIG. 2 is a plan view schematically showing a phosphor screen of the color cathode ray tube.

The outer surface of the effective portion 1 of the panel 3 is substantially flat. The phosphor screen 5 is provided on the inner surface of the panel 3. As shown in FIG. 2, the phosphor screen 5 includes stripe-shaped three-color phosphor layers 22R, 22G, and 22B, which extend parallel to the minor axis Y and glow red (R), green (G), and blue (B), respectively, and stripe-shaped black non-luminous layers 22K between the phosphor layers 22R, 22G, and 22B. The phosphor layers 22R, 22G, and 22B are arranged along the major axis X in a given order, e.g., in the order of red (R), green (G), blue (B), red (R), . . . , for example. If the interval between each two adjacent phosphor layers of each color (interval between two adjacent green phosphor layers 22G in FIG. 2) is PHp, an interval d between two of each three adjacent phosphor layers (interval between the respective centers of a red phosphor screen 22R and its adjacent blue phosphor screen 22B in FIG. 2) is adjusted to d=(⅔) PHp.

Figure 3:
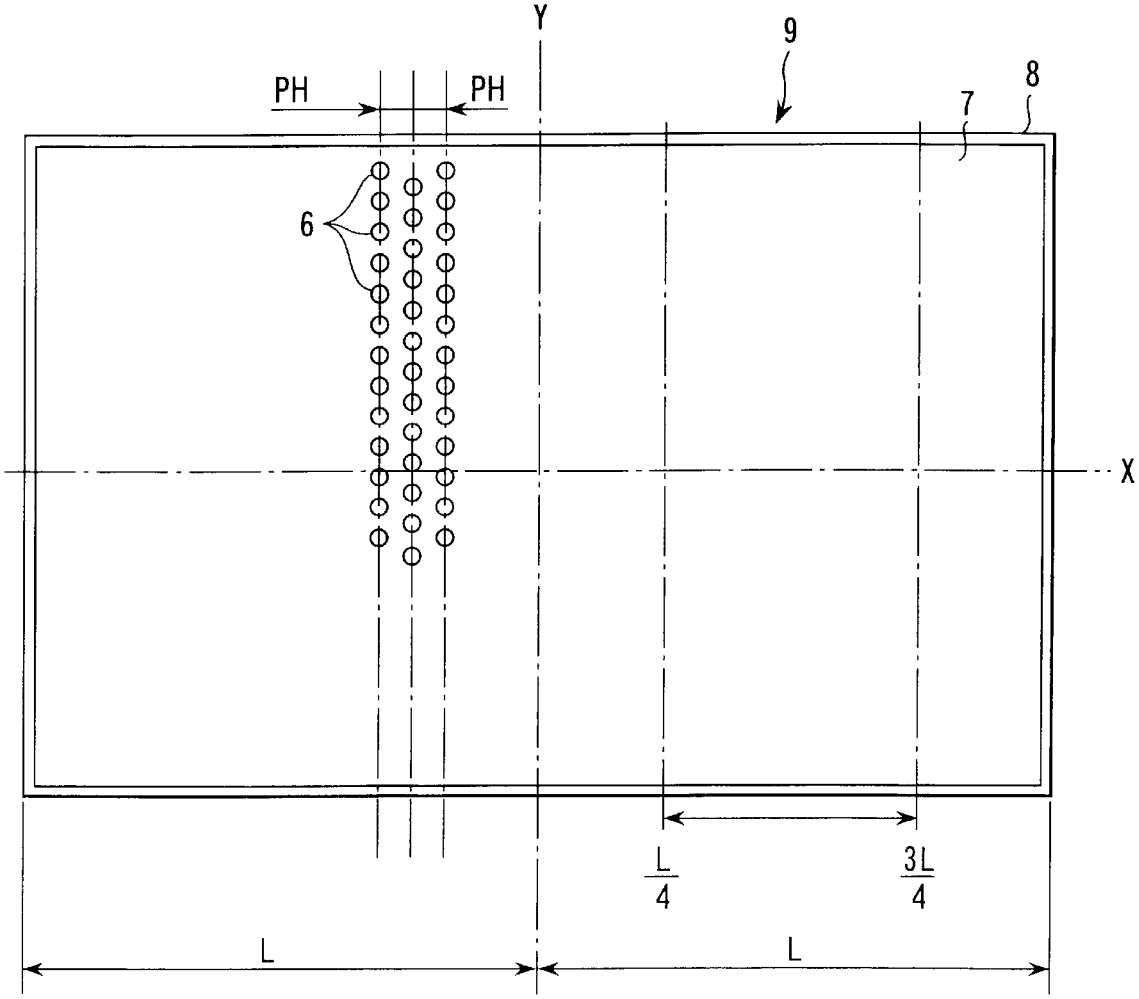
FIG. 3 is a plan view showing a shadow mask of the color cathode ray tube.

As shown in FIGS. 1 and 3, a shadow mask 9 is opposed to the phosphor screen 5 in the vacuum envelope 20. The shadow mask 9 is composed of a substantially rectangular mask body 7 opposed to the phosphor screen 5 and a rectangular mask frame 8 that supports the peripheral portion of the mask body 7. The mask body 7 is formed of a curved surface that has a large number of electron beam holes 6. The shadow mask 9 is removably supported on the panel 3 in a manner such that an elastic support 15 attached to the mask frame 8 is engaged with a stud pin 16 on the inner surface of the skirt portion 2 of the panel 3.

The in-line electron gun structure 12 is located in a neck 10 of the funnel 4. The electron gun structure 12 emits three electron beams 11R, 11G and 11B, which are arranged in a line on the same plane, toward the phosphor screen 5. A deflection yoke 13 is attached to the outer surface of the funnel 4. The deflection yoke 13 generates a non-uniform deflecting magnetic field that deflects the three electron beams 11R, 11G and 11B from the electron gun structure 12 in the directions of the horizontal and vertical axes X and Y. This non-uniform deflecting magnetic field is formed of a horizontal deflecting magnetic field of a pincushion type and a vertical deflecting magnetic field of a barrel type.

In the color cathode ray tube constructed in this manner, the three electron beams 11R, 11G and 11B emitted from the electron gun structure 12 are deflected by means of the non-uniform deflecting magnetic field that is generated by the deflection yoke 13, and are used to scan the phosphor screen 5 in the horizontal and vertical directions through the electron beam holes 6 of the shadow mask 9. Thus, a color image is displayed.

The respective configurations of the panel 3 and the shadow mask 9 will now be described further in detail.

Figure 4:
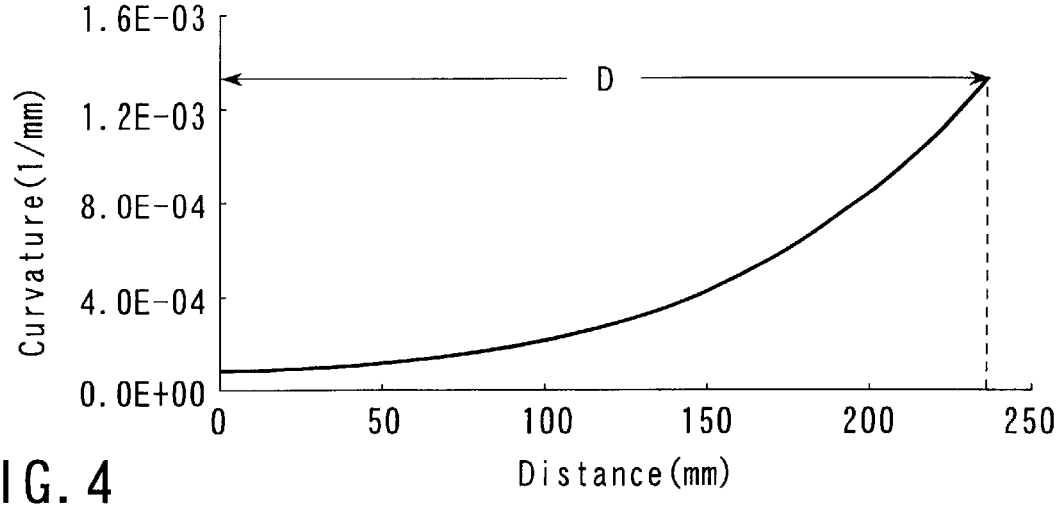
FIG. 4 is a diagram showing the curvature of the inner surface of an effective portion of a panel of the color cathode ray tube in the direction of its major axis.

The following is a description of a color cathode ray tube in which the effective diagonal diameter of the effective portion 1 is 60 cm, the aspect ratio is 4:3, and the radius of curvature of the outer surface of the panel is 10 m, for example. The outer surface of the effective portion 1 of the panel 3 is fully flattened so that the difference in thickness between the center of the panel and diagonal portions that are thicker than any other portions ranges from 8 to 15 mm, and is adjusted to, for example, 11 mm in this case. The inner surface of the effective portion 1 of the panel 3 is adjusted to the curvature shown in FIG. 4, according to the distance on the major axis X from its center to the major axis end, without reducing its flatness. If the distance from the center (inner surface center) of the inner surface of the panel's effective portion 1 to the major axis end along the major axis X is D, the average curvature of the region from the inner surface center to a middle portion corresponding to D/2, on the major axis X, is adjusted to $3.5\times10^{-4}$ (1/mm) or less, e.g., to $2.5\times10^{-4}$ (1/mm). The average curvature is the average of curvatures at several points on the major axis X between the inner surface center and a point on the major axis X at a distance Xd/2 from the center.

Figure 5:
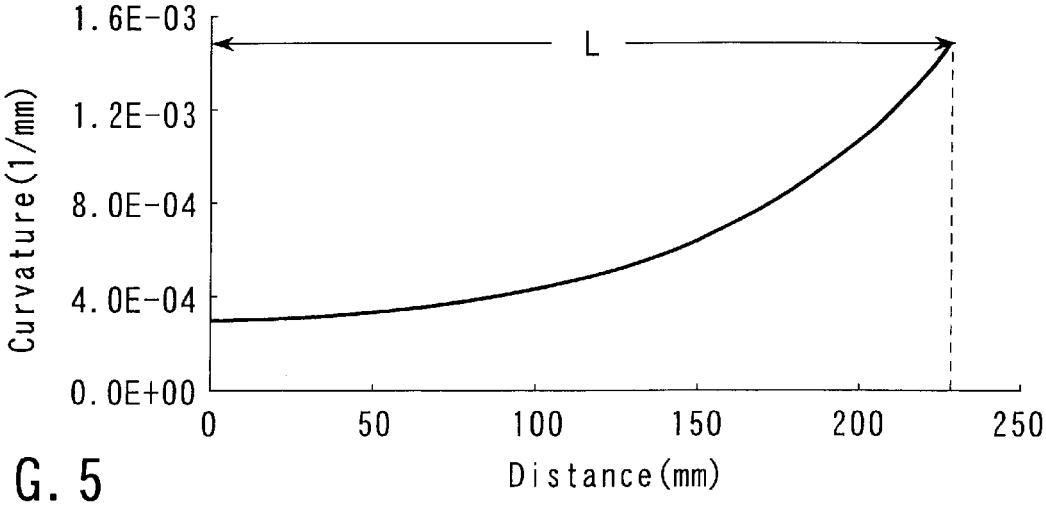
FIG. 5 is a diagram showing the major-axis-direction curvature on the major axis of the shadow mask.

Corresponding to the inner surface of the panel's effective portion 1, the mask body 7 is adjusted to the curvature shown in FIG. 5, according to the distance on the major axis X from its center to the major axis end. Thus, if the distance from the center (mask center) of the mask body 7 to the major axis end along the major axis X is L, the average curvature of the region from the mask center to a middle portion corresponding to L/2, on the major axis X, should preferably be adjusted to $2.5\times10^{-4}$ (1/mm) or more, and further preferably, to $3.6\times10^{-4}$ (1/mm). Thus, the mask body 7 can maintain satisfactory mechanical strength.

Figure 6:
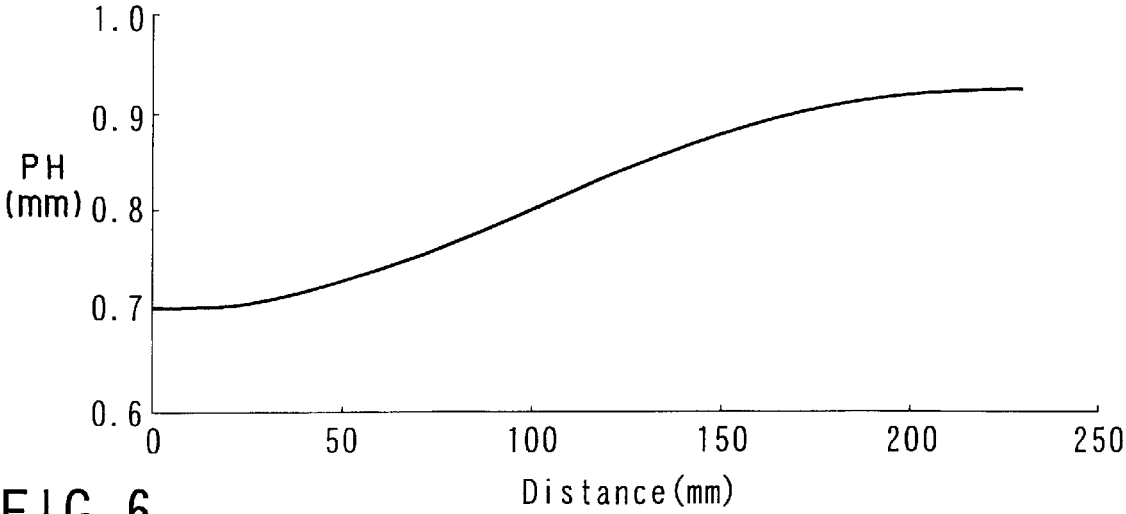
FIG. 6 is a diagram showing the major-axis-direction interval between electron beam holes on the major axis of the shadow mask.

An interval PH in the direction of the major axis X between each two adjacent rows of the electron beam holes 6 in the mask body 7 is set in the manner shown in FIG. 6 in accordance with the distance on the major axis X from the mask center to the major axis end. Thus, the interval PH tends gradually to increase from the mask center toward the major axis end, as shown in FIG. 6.

Figure 7:
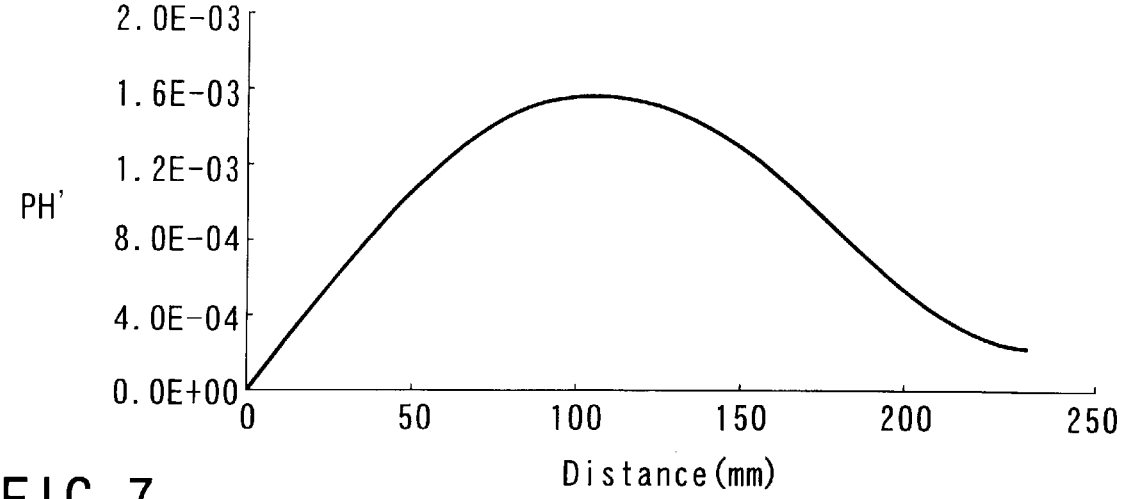
FIG. 7 is a diagram showing the rate of change of the major-axis-direction interval between the electron beam holes on the major axis of the shadow mask.

A rate of change PH' of the interval PH is set in the manner shown in FIG. 7 in accordance with the distance on the major axis X from its center to the major axis end. Thus, the rate of change PH' is set so as to have its relative maximum value between the mask center and the major axis end, as shown in FIG. 7. If the distance along the major axis X from the mask center to the major axis end is L, moreover, the rate of change PH' should preferably be set so as to have its relative maximum value in the region at the distance of L/4 to 3L/4 from the mask center.

In the region at the distance of L/4 from the mask center, the distance between the panel 3 and the shadow mask 9 is relatively constant. If the interval PH between the electron beam hole rows is changed, then the pitch PHp between the phosphor layers will change. Accordingly, it is not advisable considerably to change the interval PH in the region from the mask center to the point L/4. Further, satisfactory mask strength can be secured in the region from the point 3L/4 to the major axis end, which is situated close to the region where the mask body 7 is fixed to the mask frame 8. In the region from the point 3L/4 to the major axis end, therefore, the change of the interval PH has only a small influence upon the mask strength. Thus, in the region from the mask center of the mask body 7 to the point L/4 or 3L/4, the interval PH forms an increase function, and the rate of change PH' of the interval PH has its relative maximum value.

The interval PH between the electron beam holes in the direction of the major axis X of the mask body 7 is set according to the following expression:

$$PH=0.7+1.131\times10^{-5}\cdot x^2-1.925\times10^{-10}\cdot x^4+1.137\times10^{-15}\cdot x^6,$$

where x is the distance from the mask center on the major axis X.

If the intervals between the electron beam hole rows in the central portion and the major axis end portion of the mask body 7 are PHC and PHH, respectively, the electron beam holes 6 are formed in the mask body 7 so as to fulfill $$PHH\leqq1.4\ PHC.$$

According to the color cathode ray tube constructed in this manner, beam landing may be dislocated by local doming of the mask body or deformation of the mask body that is attributable to the manufacturing process or external impact. Even in this case, the electron beams can be prevented from traversing the black non-luminous layers 22K and causing any other phosphor layers than the phosphor layer of a desired color to glow. In consequence, deterioration of color purity can be lessened to improve the image quality.

Figure 11:
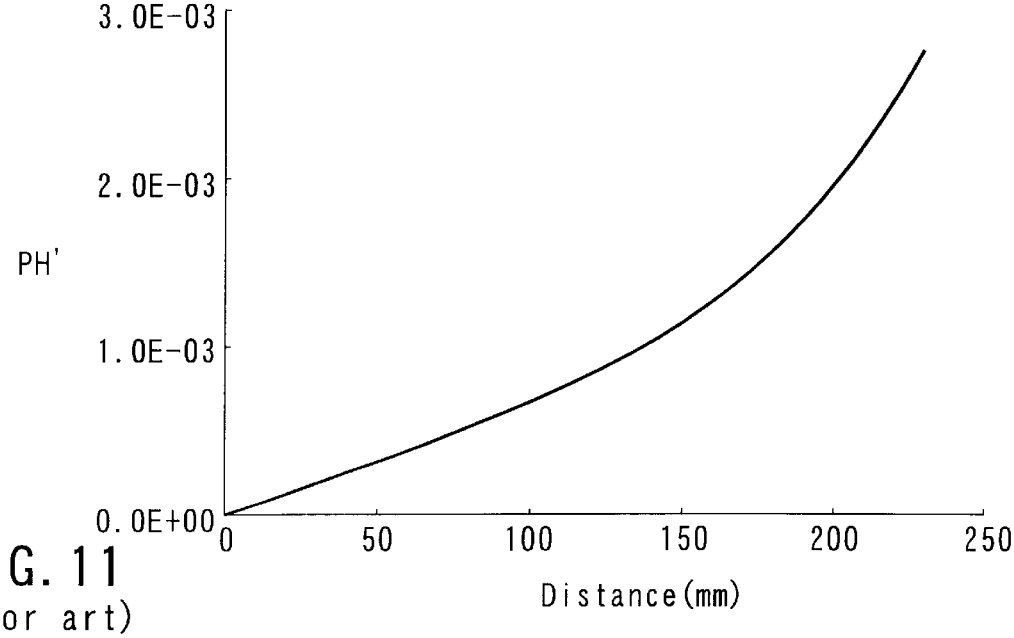
FIG. 11 (Prior art)
FIG. 11 is a diagram showing the rate of change of the major-axis-direction interval between electron beam holes on the major axis of a conventional shadow mask.
Figure 12:
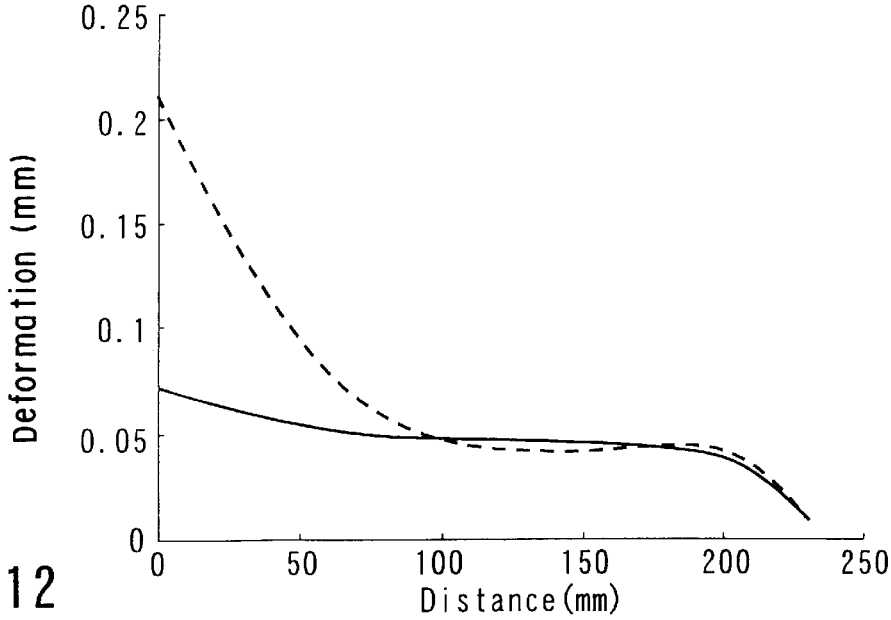
FIG. 12 is a diagram showing results of comparison between the respective deformations of the shadow masks.

The conventional shadow mask having the rate of change PH' of the interval PH between the electron beam hole rows shown in FIG. 11 and the shadow mask according to the present embodiment described above were compared for deformation. For the comparison between their deformations, the shadow masks were subjected to impact acceleration of 1 G as an index of their mechanical strength. The deformation of the conventional shadow mask that is caused by external impact is greater in the region near the center (mask center) than in the region from the middle portion (L/2) to the major axis end, as indicated by broken line in FIG. 12. In the region near the middle portion on the major axis, therefore, there is a high possibility of the difference in deformation causing plastic deformation. In the case of the shadow mask of the present embodiment, on the other hand, the deformation caused by impact is balanced throughout the region from the mask center to the major axis end, as indicated by full line in FIG. 12. Thus, the shadow mask of this embodiment is less deformable.

The shadow mask cannot have satisfactory curvatures in the regions near its central portion and the major axis end portion. In order to balance the deformation, as indicated by full line in FIG. 12, therefore, the rate of change PH' is expected to have its relative maximum value in the region from the position at the distance of L/4 from the mask center to the position at the distance of 3L/4, along the major axis X. Preferably, the rate of change PH' should have its relative maximum value near the region at the distance of L/2 from the mask center.

As mentioned above, the average curvature of the region from the inner surface center of the effective portion 1 of the panel 3 to the region near the middle portion, along the major axis X, is adjusted to the relatively small value, $3.5\times10^{-4}$ (1/mm) or less, and the mask body 7 has a curvature high enough to maintain satisfactory mechanical strength in the region near the middle portion along the major axis X. Further, the rate of change PH' of the interval PH between the electron beam hole rows has its relative maximum value in the region at the distance of L/4 to 3L/4 from the mask center. Thus, the interval along the major axis X between the electron beam holes in the peripheral portion of the mask body can be set so that satisfactory resolution can be obtained.

Figure 8:
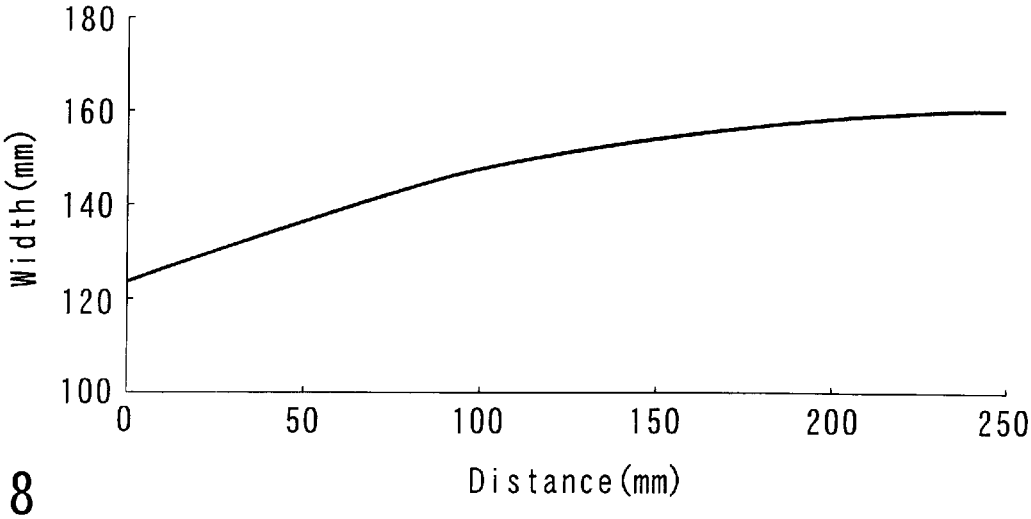
FIG. 8 is a diagram showing change of the width of black non-luminous layers of the phosphor screen on the major axis of the panel.

As shown in FIG. 8, moreover, the black non-luminous layers 22K of the phosphor screen 5 can be effectively made wide enough in the region (middle portion along the major axis X) where the electron beam landing is dislocated most by the local doming of the mask body. Thus, deterioration of color purity can be restrained even in case the local doming is caused.

In this case, the allowance of the black non-luminous layers 22K to cover the landing mistake of the electron beams that is attributable to the local doming can be secured satisfactorily without changing the following conditions or figures. The figures include 50% for the percentage of the black non-luminous layers 22K at the point corresponding to ½ of the distance from the center of the effective portion of the phosphor screen 5 to the major axis end, 150 $\mu$m for the width, 2.3 mm for the difference in wall thickness between the central and peripheral portions of the effective portion 1 of the panel, and 47% for the panel transmission factor that ensures satisfactory brightness.

The following is a description of a second embodiment of the invention.

Figure 9:
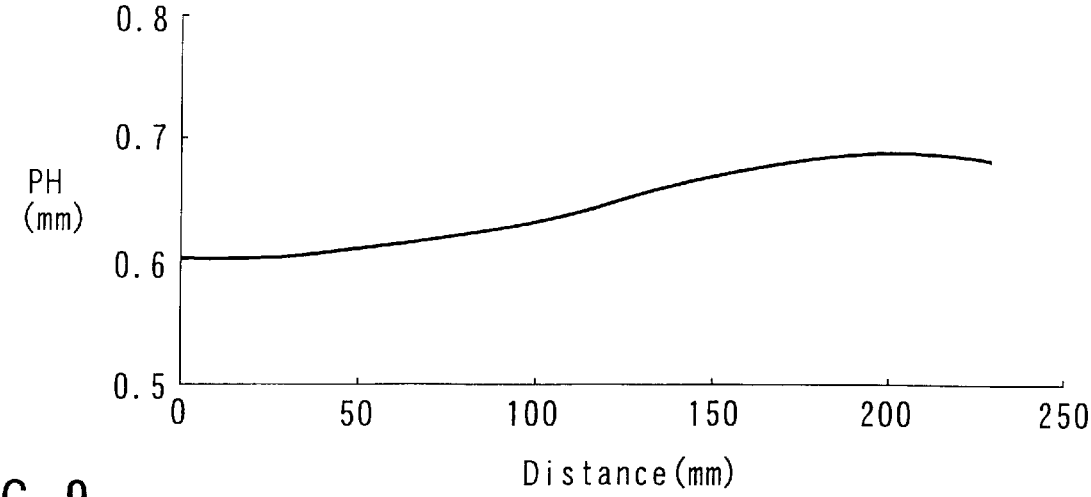
FIG. 9 is a diagram showing the major-axis-direction interval between electron beam holes on the major axis of a shadow mask in a color cathode ray tube according to a second embodiment of the invention.
Figure 10:
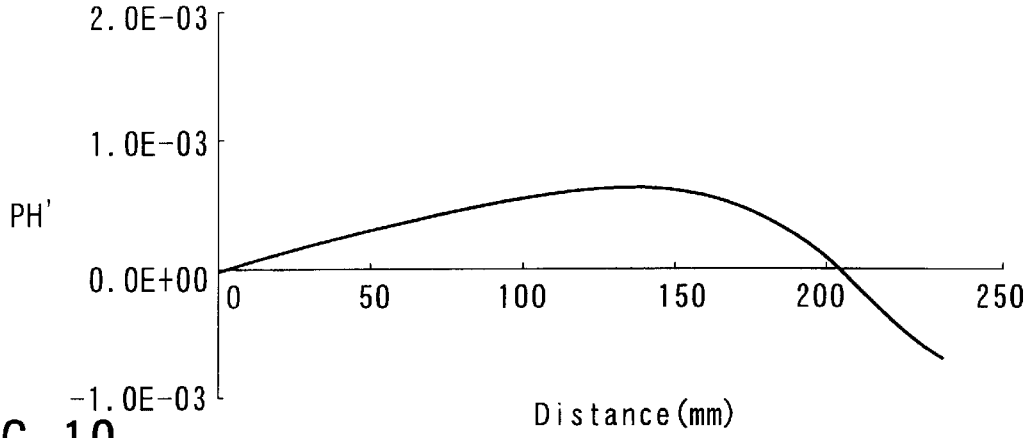
FIG. 10 is a diagram showing the rate of change of the major-axis-direction interval between the electron beam holes on the major axis of the shadow mask in the color cathode ray tube of the second embodiment.

According to a color cathode ray tube of the second embodiment, as shown in FIGS. 9 and 10, the interval along the major axis between the electron beam holes in the mask body is made shorter than that of the first embodiment, in order to cope with the additional flatness and higher resolution of the effective portion of the panel.

For example, the interval PH between the electron beam hole rows along the major axis X of the mask body 7 is set according to the following expression:

$$PH=0.6+3.142\times10^{-6}\cdot x^2-7.680\times10^{-12}\cdot x^4-4.534\times10^{-16}\cdot x^6,$$

where $\underline{x}$ is the distance from the mask center on the major axis X.

Further, the interval PH increases substantially at a fixed rate along the major axis X from the central portion of the mask body to the major axis end. The interval PHH between the electron beam hole rows in the major axis end portion of the mask body, compared with the interval PHC between the electron beam hole rows in the central portion of the mask body, is set as follows:

$$PHH=1.1\ PHC.$$

In order to secure satisfactory mask strength, moreover, the interval PH between the electron beam hole rows is set so that it has its maximum value in the region from the position at the distance of 3L/4 along the major axis X from the mask center to the major axis end, and that the interval between the electron beam hole rows at the major axis end is not greater than the maximum value.

Thus, the rate of change PH' of the interval between the electron beam holes can enjoy its relative maximum value in the middle portion on the major axis of the mask body without lowering satisfactory resolution even in the peripheral portion of the panel. As in the case of the first embodiment described above, therefore, the black non-luminous layers can be made wide enough in the middle portion on the major axis of the phosphor screen, and deterioration of color purity that is attributable to dislocation of beam landing can be restrained.

The present invention is not limited to the two embodiments described above, and various changes and modifications may be effected therein by one skilled in the art without departing from the scope or spirit of the invention. For example, the invention is not limited to a color cathode ray tube with the aspect ratio of 4:3, and may be also applied to a color cathode ray tube with the aspect ratio of 16:9.

According to the present invention, as described in detail herein, there may be provided a color cathode ray tube that can prevent deterioration of color purity that is attributable to dislocation of beam landing caused by the deformation or doming of the shadow mask, thereby ensuring improved image quality.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel, having a substantially rectangular effective portion with a substantially flat outer surface, and a funnel bonded to the panel;

a phosphor screen formed on an inner surface of the panel and including phosphor layers and black non-luminous layers;

an electron gun structure located in a neck of the funnel and capable of emitting electron beams toward the phosphor screen; and a shadow mask opposed to the phosphor screen and including a substantially rectangular mask body formed having a large number of electron beam holes and a mask frame supporting of the mask body, wherein:

the envelope having a tube axis extending through the respective centers of the effective portion and the electron gun structure, a major axis extending at right angles to the tub axis, and a minor axis extending at right angles to the tube axis and the major axis, the interval between each two adjacent electron beam holes on the major axis of the mask body being greater at the major axis end of the mask body than in the center, the interval between the electron beam holes increasing toward the major axis end so that the rate of change of the interval has a relative maximum value in the region at the distance of L/4 to 3L/4 from the center of the mask body, where L is the distance from the center of the mask body to the major axis end along the major axis, and the rate of change of said interval between the electron beam holes in the direction of the major axis has a relative maximum value at a point near the region at a distance of L/2 from the center of the mask body.

2. A color cathode ray tube according to claim 1, wherein intervals PHC and PHH in the direction of the major axis between the electron beam holes in the central portion and the major axis end portion of the mask body are related as follows:

$$PHH\leq1.4\ PHC.$$

3. A color cathode ray tube comprising:

an envelope including a panel, having a substantially rectangular effective portion with a substantially flat outer surface, and a funnel bonded to the panel;

a phosphor screen formed on an inner surface of the panel and including phosphor layers and black non-luminous layers;

an electron gun structure located in a neck of the funnel and capable of emitting electron beams toward the phosphor screen; and a shadow mask opposed to the phosphor screen and including a substantially rectangular mask body formed having a large number of electron beam holes and a mask frame supporting of the mask body, wherein:

the envelope having a tube axis extending through the respective centers of the effective portion and the electron gun structure, a major axis extending at right angles to the tub axis, and a minor axis extending at right angles to the tube axis and the major axis, the interval between each two adjacent electron beam holes on the major axis of the mask body being greater at the major axis end of the mask body than in the center, the interval between the electron beam holes increasing toward the major axis end so that the rate of change of the interval has a relative maximum value in the region at the distance of L/4 to 3L/4 from the center of the mask body, where L is the distance from the center of the mask body to the major axis end along the major axis, and said interval between the electron beam holes has a maximum value in the region from a point corresponding to 3L/4 to the major axis end, and said interval between the electron beam holes at the major axis end is not greater than the maximum value.

4. A color cathode ray tube comprising:

an envelope including a panel, having a substantially rectangular effective portion with a substantially flat outer surface, and a funnel bonded to the panel;

a phosphor screen formed on an inner surface of the panel and including phosphor layers and black non-luminous layers;

an electron gun structure located in a neck of the funnel and capable of emitting electron beams toward the phosphor screen; and a shadow mask opposed to the phosphor screen and including a substantially rectangular mask body formed having a large number of electron beam holes and a mask frame supporting of the mask body, wherein:

the envelope having a tube axis extending through the respective centers of the effective portion and the electron gun structure, a major axis extending at right angles to the tub axis, and a minor axis extending at right angles to the tube axis and the major axis, the interval between each two adjacent electron beam holes on the major axis of the mask body being greater at the major axis end of the mask body than in the center, the interval between the electron beam holes increasing toward the major axis end so that the rate of change of the interval has a relative maximum value in the region at the distance of L/4 to 3L/4 from the center of the mask body, where L is the distance from the center of the mask body to the major axis end along the major axis, and the average curvature of the region from the center of the inner surface of panel to a point corresponding to D/2, on the major axis, is adjusted to $3.5\times10^{-4}$ (1/mm) or less, where D is the distance from the center of the inner surface of the panel to the major axis end along the major axis, and the average curvature of the region from the center of the mask body to a point corresponding to L/2 is adjusted to $2.5\times10^{-4}$ (1/mm) or more, where L is the distance from the center of the mask body to the major axis end along the major axis.

* * * * *